US011919689B2

(12) United States Patent
Hayter et al.

(10) Patent No.: US 11,919,689 B2
(45) Date of Patent: Mar. 5, 2024

(54) BLANK FOR FORMING AN ARTICLE CARRIER

(71) Applicant: WestRock Packaging Systems, LLC, Atlanta, GA (US)

(72) Inventors: Gregory P. Hayter, Atlanta, GA (US); Matthew E. Zacherle, Chesterfield, VA (US); Andrew T. Peeler, Richmond, VA (US); Calvin L. Peterson, Valley, AL (US); Brian D. Souza, Auburn, AL (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/124,220

(22) Filed: Mar. 21, 2023

(65) Prior Publication Data

US 2023/0331450 A1 Oct. 19, 2023

Related U.S. Application Data

(63) Continuation of application No. 17/043,408, filed as application No. PCT/US2019/023539 on Mar. 22, 2019, now Pat. No. 11,608,218.

(Continued)

(51) Int. Cl.
*B65D 71/58* (2006.01)

(52) U.S. Cl.
CPC ..... *B65D 71/0022* (2013.01); *B65D 2571/00141* (2013.01); *B65D 2571/00388* (2013.01);

(Continued)

(58) Field of Classification Search
CPC ..... B65D 71/0022; B65D 2571/00141; B65D 2571/00388; B65D 2571/00487;

(Continued)

(56) References Cited

U.S. PATENT DOCUMENTS 2,772,020 A * 11/1956 Kramer ..... B65D 71/0022 206/180
3,105,608 A * 10/1963 Engel ..... B65D 5/46064 206/177

(Continued)

*Primary Examiner* — Jacob K Ackun
(74) *Attorney, Agent, or Firm* — Brian J. Goldberg; Rohini K. Garg

(57) ABSTRACT

Aspects of the disclosure relate to an article carrier (90) for packaging a plurality of articles and to a blank (10) for forming the article carrier. The article carrier comprises a plurality of primary panels (12,14,16,18) for forming a tubular structure and defining an interior thereof. The plurality of primary panels includes a first panel (12) and a second panel (14) opposing the first panel. The article carrier further comprises a partition structure for dividing the interior into two or more article-receiving cells. The carrier is formed form a blank comprising a partition-forming section (PS) which comprises a primary partition panel (22,24) and a secondary partition panel(40,44,36,46) formed from the primary partition panel and hingedly connected at one of the opposing ends thereof to the primary partition panel. The upper edge (E1) of the secondary partition panel is defined at least in part by a cutaway (R1) extending from a free end edge (E3) of the blank.

20 Claims, 6 Drawing Sheets

Related U.S. Application Data

(60) Provisional application No. 62/650,684, filed on Mar. 30, 2018.

(52) U.S. Cl.
CPC ..... *B65D 2571/00487* (2013.01); *B65D 2571/0066* (2013.01); *B65D 2571/00728* (2013.01); *B65D 2571/00845* (2013.01); *B65D 2571/0087* (2013.01)

(58) Field of Classification Search
CPC .. B65D 2571/0066; B65D 2571/00728; B65D 2571/00845; B65D 2571/0087
USPC ..... 206/193
See application file for complete search history.

(56) References Cited

U.S. PATENT DOCUMENTS

| | | | | |
|---|---|---|---|---|
| 6,168,013 | B1 * | 1/2001 | Gomes | B65D 71/0022 206/162 |
| 6,598,739 | B1 * | 7/2003 | Collura | B65D 71/0022 206/185 |
| 11,608,218 | B2 * | 3/2023 | Hayter | B65D 71/0022 |
| 2005/0103651 | A1 * | 5/2005 | Lebras | B65D 71/0055 206/427 |
| 2017/0297795 | A1 * | 10/2017 | Zacherle | B65D 5/02 |
| 2019/0300231 | A1 * | 10/2019 | Zacherle | B65D 5/4608 |
| 2021/0229884 | A1 * | 7/2021 | Peeler | B65D 71/0022 |

* cited by examiner

BLANK FOR FORMING AN ARTICLE CARRIER

TECHNICAL FIELD

The present disclosure relates to blanks and to carriers formed therefrom. More specifically, but not exclusively, the disclosure relates to a blank having a partition structure feature defining cells or compartments within an interior of a carrier of the basket-style.

BACKGROUND

In the field of packaging it is known to provide article carriers or cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present disclosure to provide to a carrier having a partition structure for separating articles within an interior chamber of the carrier. It is desirable to minimise or reduce the material required to produce the carrier for economic or environmental benefit or both.

It is desirable that assembly of the carton from a carton blank is automated. This is typically carried out by a packaging machine. Another object of the present disclosure is to provide a blank which can be more readily assembled by a packaging machine, to improve the accuracy, precision and consistency of the manufacturing process.

The present invention seeks to provide an improvement in the field of cartons and carton blanks, typically formed from paperboard or the like.

SUMMARY

A first aspect of the disclosure provides a blank for forming an article carrier. The blank comprises a partition-forming section which comprises a primary partition panel the primary partition panel having opposing ends. The partition-forming section comprises a secondary partition panel formed from the primary partition panel. The secondary partition panel has opposing ends and is hingedly connected at one of the opposing ends to the primary partition panel. An upper edge of the secondary partition panel is defined at least in part by a cutaway extending from a free end edge of the blank.

Optionally, the cutaway extends transversely of a fold line hingedly connecting the secondary partition panel to the primary partition panel.

Optionally, the secondary partition panel is an end-most one of three or more secondary partition panels formed from the primary partition panel. The three or more secondary partition panels are disposed substantially parallel to one another to define four or more article-receiving cells when the blank is erected into a carton.

Optionally, a lower edge of the secondary partition panel is adjoined by a glue panel for hingedly connecting the other one of the opposing ends of the secondary partition to another part of the blank. The lower edge extends entirely along the glue panel which is separated from the lower edge by a cut line.

Optionally, the glue panel is adjoined by a further secondary partition panel formed from the primary partition panel. The further secondary partition panel is hingedly connected between the primary partition panel and the glue panel. The further secondary partition panel has upper and lower opposing edges. The upper edge extends entirely along the glue panel which is separated from the upper edge by a second cut line. The lower edge of the further secondary partition panel is defined at least in part by a second slot/notch extending from the free end edge of the blank.

Optionally, the cutaway may have a pair of opposed free edges each being disposed transversely of the fold line connecting the secondary partition panel to the primary partition panel. Each of the free edges may optionally be oblique with respect to a longitudinal axis of the blank which is generally perpendicular to the fold line. The opposed free edges may optionally define an acute angle therebetween.

A second aspect of the disclosure provides a blank for forming an article carrier. The blank comprises a partition-forming section which comprises first and second primary partition panels hingedly connected together along a first fold line. The first fold line is parallel to a longitudinal axis of the blank. The partition-forming section comprises first and second secondary partition panels formed from the first primary partition panel and hingedly connected thereto by spaced parallel second and third fold lines respectively. The second and third fold lines may be generally perpendicular to the longitudinal axis. Each of the first and second secondary partition panels comprises opposed ends. Each of the first and second secondary partition panels is connected at one of the opposed ends to the first primary partition panel by a respective one of the second and third fold lines.

A common glue panel hingedly connects between the respective other ends of the first and second secondary partition panels. The glue panel may extend along the longitudinal axis. The first secondary partition panel is disposed on one side of the glue panel such that the glue panel is interposed between the second primary partition panel and the first secondary partition panel. The partition-forming section further comprises a third secondary partition panel hingedly connected between the glue panel and the first primary partition panel. The third secondary partition panel is disposed on the other side of the glue panel so as to be interposed between the glue panel and the second primary partition panel. The third secondary partition panel has first and second edges. The first edge adjoins the glue panel and the second edge is disposed opposite to the first edge. The second edge is disposed adjacent to the second primary partition panel such that no other part of the blank is disposed between the third secondary partition panel and the second primary partition panel.

Optionally, the second edge of the third secondary partition panel is separated from the second primary partition panel at least partially by a cutaway extending from a free end edge of the blank.

Optionally, the partition-forming section further comprises a fourth secondary partition panel hingedly connecting between the glue panel and the first primary partition panel. The fourth secondary partition panel is disposed such that the second secondary partition panel is disposed between the first and fourth secondary partition panels. The second secondary partition panel is disposed on the one side of the glue panel such that a portion of the first primary partition panel is disposed between the glue panel and the second primary partition panel and said portion is hingedly connected to the second primary partition panel along the first fold line.

Optionally, the portion of the first primary partition panel is glued to the second primary partition panel when the blank is erected into a carton.

Further features and advantages of the present invention will be apparent from the specific embodiments illustrated in the drawings and discussed below.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
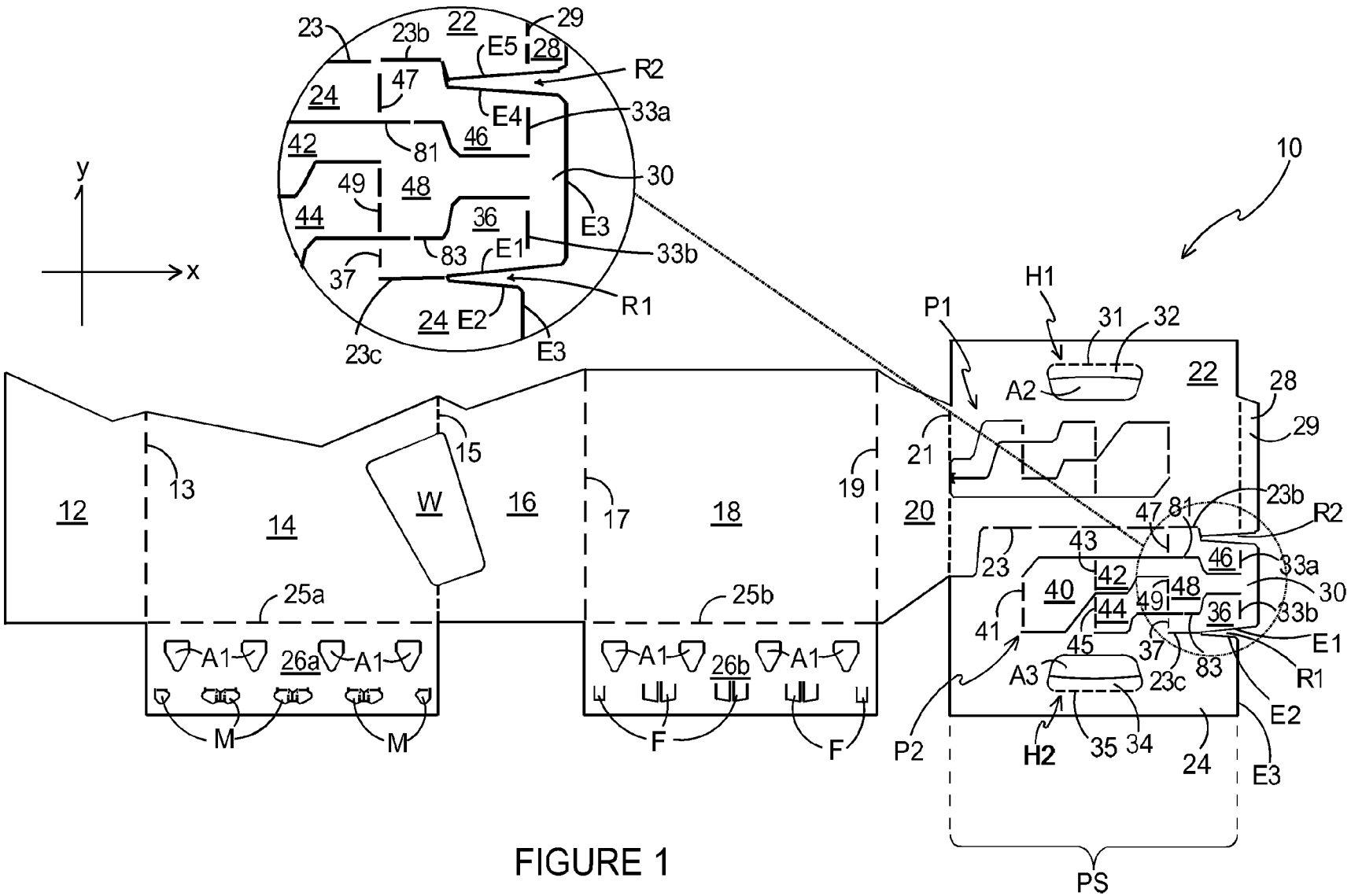
FIG. 1 is a plan view from above of a blank for forming a carrier according to a first embodiment, an enlarged view of an end portion of the blank is inset.
Figure 2:
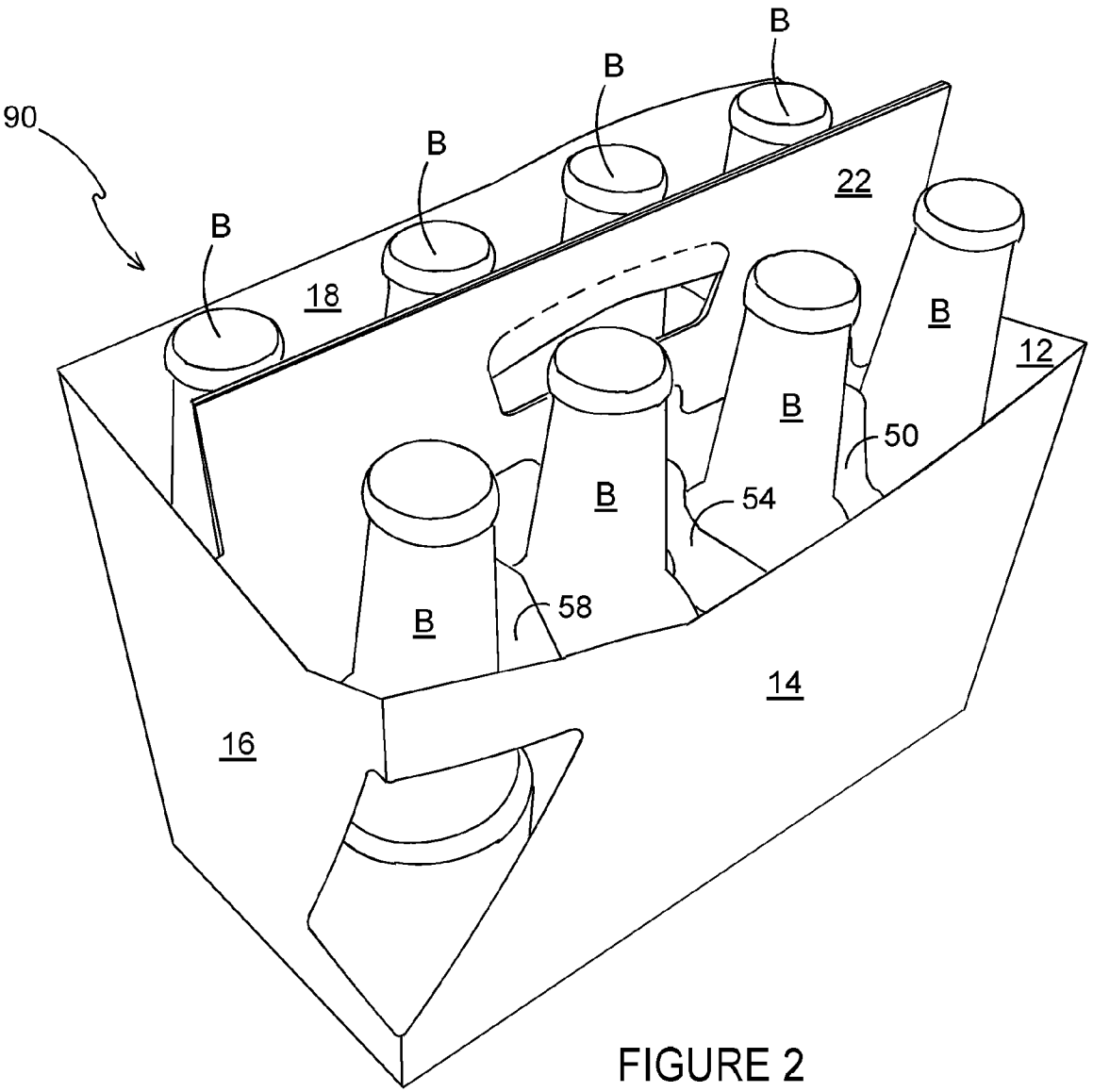
FIG. 2 is a perspective view from above of a carton formed from the blank of FIG. 1.
Figure 3:
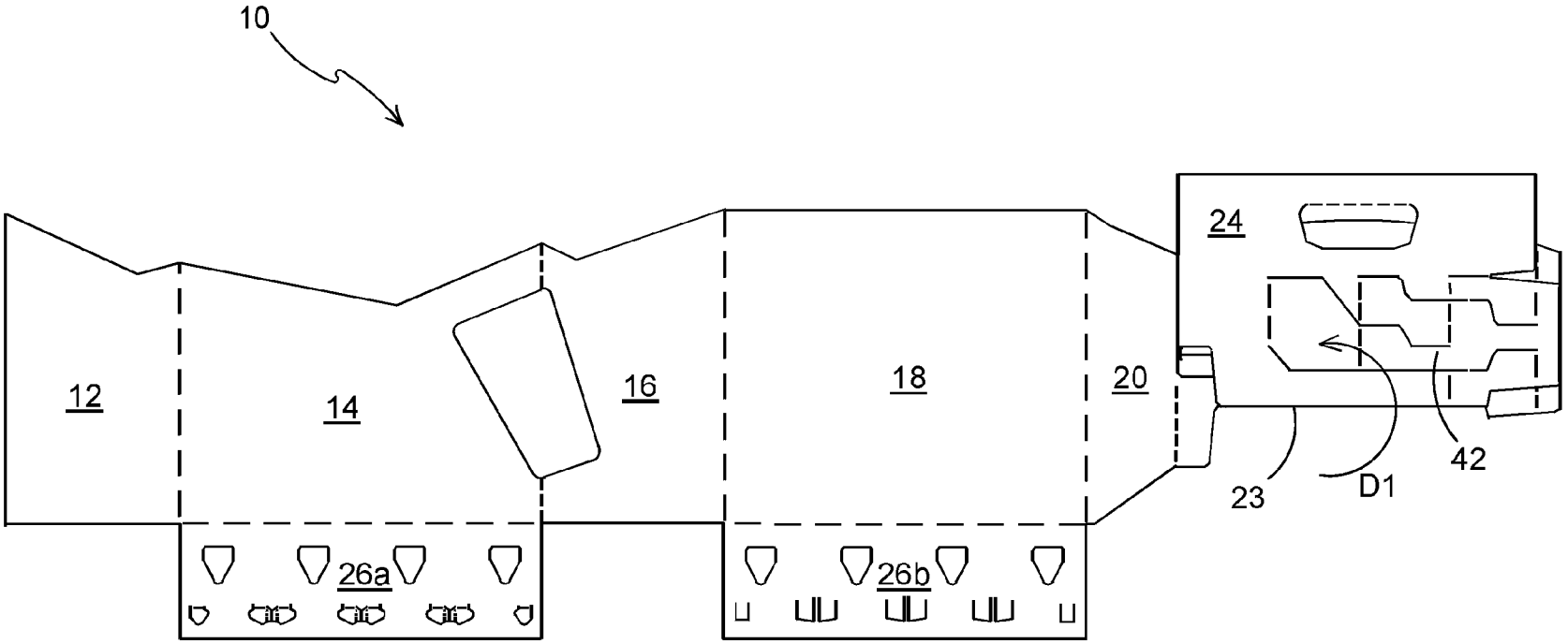
FIGS. 3 to 6 illustrate stages of construction of the blank of FIG. 1 into a flat collapsed carrier.

Referring to FIG. 1, there is shown a plan view of a blank 10 capable of forming a carton or carrier 90, as shown in FIG. 2, for containing and carrying a group of primary products such as, but not limited to, bottles, hereinafter referred to as articles B. The blank 10 forms a secondary package of the basket-carrier style for packaging at least one primary product container or package.

In the embodiments detailed herein, the terms "carton" and "carrier" refer, for the non-limiting purpose of illustrating the various features of the invention, to a container 90 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structure or carton 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blank 10 is configured to form a carton or carrier 90 for packaging an exemplary arrangement of exemplary articles B. In the illustrated embodiments the arrangement is an m×n matrix or array, having two rows (m=2) and four columns (n=4); in the illustrated embodiment two rows of four articles B are provided, and the articles B are 16 fl. oz. (473 ml) bottles, the bottle may be formed from a suitable material such as, but not limited to, glass, Aluminium or PET (polyester—polyethylene terephthalate). Alternatively, the blank 10 can be configured to form a carrier for packaging other types, number and size of articles B and/or for packaging articles B in a different arrangement or configuration for example, but not limited to, fully enclosed cartons or wrap-around carriers, the articles B may be cups, pouches, pots or cans.

Turning to FIG. 1, there is illustrated a blank 10 for forming a carton 90 (see FIG. 2) according to a first embodiment. The blank 10 comprises a plurality of main panels 12, 14, 16, 18, 20 for forming a tubular structure. The plurality of main panels 12, 14, 16, 18, 20 comprises a first outer end panel 12 (or outer layer), a first side panel 14, a second end panel 16, a second side panel 18, and a first inner end panel or securing panel (or inner layer) 20. The plurality of panels 12, 14, 16, 18, 20 may be arranged in a linear series hinged one to the next by corresponding fold lines 13, 15, 17, 19.

The blank 10 comprises a first base panel 26*a* hinged to the first side panel 14 by a hinged connection in the form of a fold line 25*a*. The blank 10 comprises a second base panel 26*b* hinged to the second side panel 18 by a hinged connection in the form of a fold line 25*b*.

The first and second base panels 26*a*, 26*b* are engageable with one another in an overlapping relationship to form a composite base wall 26*a*/26*b* of the carrier 90. The blank 10 may comprise a complementary locking mechanism for securing the first base panel 26*a* to the second base panel 26*b*. The first base panel 26*a* may comprise at least one first part M of the complementary locking mechanism. The second base panel 26*b* may comprise at least one second part F of the complementary locking mechanism. In the illustrated embodiment, the first base panel 26*a* comprises five male tabs M struck therefrom so as to be defined within the first base panel 26*a*. Each of the male tabs M is hingedly connected to the first base panel 26*a* by a hinged connection in the form of a fold line.

The second part F of the complementary locking mechanism forms a receiver. The receiver comprises an opening or slot for receiving the male tab M.

The second base panel 26*b* comprises five optional female tabs each defining an opening or slot in the second base panel 26*b*; the female tabs forming at least part of the receiver.

The openings in the second base panel 26*b* are configured to receive respective ones of the male tabs M.

The female tabs are arranged to be displaced out of the second base panel 26*b* to form said openings and to bear against the respective male tab M when received therein. In some embodiments the complementary locking mechanism M/F may be omitted, the first and second base panels 26*a*, 26*b* may be secured to each other by other means, such as but not limited to adhesive or staples.

Optionally, the first and second base panels 26*a*, 26*b* may comprise at least one first aperture A1. In the illustrated embodiment, each of the first and second base panels 26*a*, 26*b* comprises four first apertures A1. The first apertures A1 may be employed to facilitate construction of the carton 90. A packaging machine component or tool may engage with the first apertures A1 to facilitate alignment of the first and second base panels 26*a*, 26*b* with respect to each other or to align the first part M of the complementary locking mechanism with the second part F of the complementary locking mechanism. The complementary locking mechanism illustrated and described is entirely optional.

The blank 10 optionally comprises a display window aperture W struck in part from the first side panel 14 and in part from the second end panel 16. In a set up carrier the display window aperture W exposes to view a portion of an article B disposed adjacent thereto. The display window is provided about a corner of the tubular structure formed from the plurality of main panels 12, 14, 16, 18, 20. The display window exposes to view a portion of an article B disposed at one end of a first one of the rows of articles B.

A section PS of the blank 10 provides or forms a partition in the carrier 90 (section PS is also referred to herein as a partition-forming section).

The blank 10 may comprise a medial structure including a first medial panel 22 (also referred to as a second primary partition panel) and a second medial panel 24 (also referred to as a first primary partition panel).

The first medial panel 22 is hingedly connected at a first end to the first inner end panel 20 by a hinged connection in the form of a fold line 21.

The second medial panel 24 is hingedly connected to the first medial panel 22 along a lower edge thereof by a hinged connection in the form of a fold line 23. Fold line 23 is parallel to the longitudinal axis x of the blank 10.

In alternative embodiments, the blank 10 may comprise a single primary partition panel. The first medial panel 22 may be omitted and the second medial panel 24 may be hingedly connected to the first inner end panel 20.

The first and second medial panels 22, 24 form a divider extending longitudinally between the first inner and outer end panels 12, 20 and the second end panel 16.

Optionally, the first medial panel 22 provides a first handle structure H1. The second medial panel 24 provides a second handle structure H2. Together the first and second medial panels 22, 24 provide a two ply handle structure, the second ply reinforcing the first ply.

The first handle structure H1 may comprise a first handle opening.

The first handle opening may be defined in part by a first handle aperture A2 struck from an upper portion of the first medial panel 22.

The first handle structure H1 may comprise an optional first cushioning flap 32 struck from the first medial panel 22 and hinged thereto by a hinged connection in the form of a fold line 31. The first cushioning flap 32 defines at least a part of the first handle opening.

Optionally, the second handle structure H2 comprises a second handle opening.

The second handle opening may be defined in part by a second handle aperture A3 struck from, or defined within, an upper portion of the second medial panel 24.

The second handle structure H2 may comprise an optional second cushioning flap 34 struck 35 from the second medial panel 24 and hinged thereto by a hinged connection in the form of a fold line 35. The second cushioning flap 34 defines at least a part of the second handle opening.

The second handle opening is arranged to be disposed in registry or alignment with the first handle opening.

The blank 10 comprises a medial partition glue flap 28. In the illustrated embodiment the medial partition glue flap 28 is hingedly connected to the first medial panel 22 along a second end (the second end opposes the first end, the first end is defined by fold line 21) by a hinged connection in the form of a fold line 29. In other embodiments, the medial partition glue flap 28 may be connected or joined to the second medial panel 24.

Figure 1A:
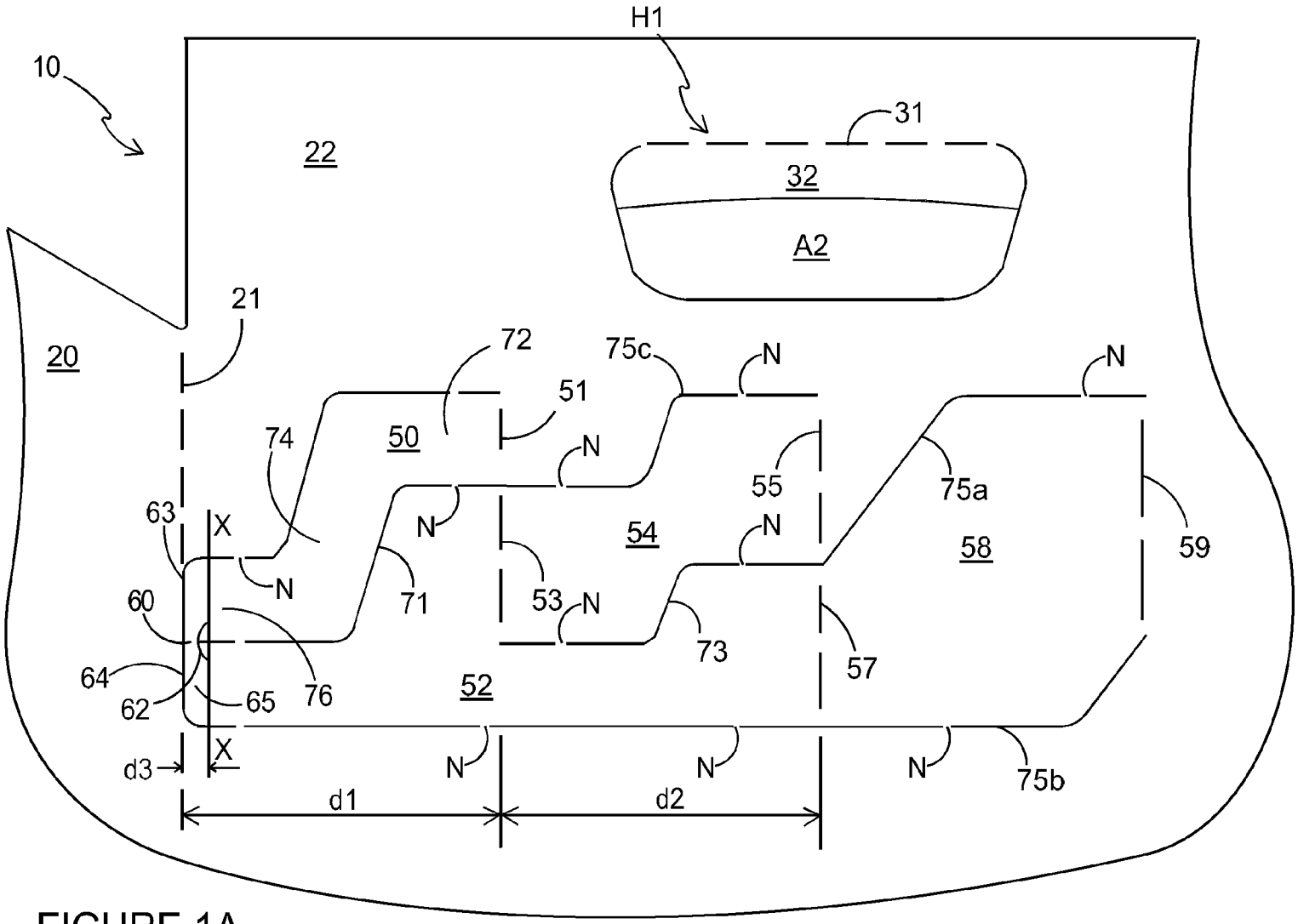
FIG. 1A is an enlarged view of a portion of the blank of FIG. 1.

Optionally, the blank 10 comprises a first partition structure P1 best illustrated in FIG. 1A. The first partition structure P1 defines or creates a plurality of cells disposed between the first side panel 14 and the first medial panel 22. The first side panel 14 and the first medial panel 22 along with portions of the first and second end panels 12, 16 define a tubular structure or first compartment on a first side of the medial structure.

The first compartment provides an interior for receiving at least a lower portion of one or more articles B.

The first partition structure P1 comprises a first partition panel 50 struck from the first medial panel 22 and hingedly connected, at a first or proximal end, thereto by a hinged connection in the form of a fold line 51.

The first partition structure P1 comprises a second partition panel 54 struck from the first medial panel 22 and hingedly connected, at first or a proximal end, thereto by a hinged connection in the form of a fold line 55.

The first partition structure P1 comprises a third partition panel 58 struck from the first medial panel 22 and hingedly connected thereto by a hinged connection in the form of a fold line 59.

The first, second and third partition panels 50, 54, 58 are dimensioned to extend between the first medial panel 22 and the first side panel 14 in a set up condition.

The first partition structure P1 comprises a first glue panel 52 to which the first, second and third partition panels 50, 54, 58 are each coupled by distal end joints.

The third partition panel 58 is hingedly connected, at a second or distal end, to a first end of the first glue panel 52 by a hinged connection in the form of fold line 57. Fold line 57 defines an outer end of the third partition panel 58, fold line 59 defines an inner end of the third partition panel 58 a linear dimension is defined therebetween.

Fold line 57 is collinear with fold line 55 in the blank 10.

The second partition panel 54 is hingedly connected, at a second or distal end, to an intermediate portion of the first glue panel 52 by a hinged connection in the form of fold line 53. Fold line 53 defines an outer end of the second partition panel 54, fold line 55 defines an inner end of the second partition panel 54, and a linear dimension, denoted by dimension arrow d2 in FIG. 1A, is defined therebetween.

Fold line 53 is collinear with fold line 51 in the blank 10.

The first partition panel 50 is separated from the first glue panel 52 along or by a cut line or severance line 71. The first partition panel 50 may be severably coupled to the first glue panel 52 by one or more connecting portions or nicks N which interrupt the cut line or severance line 71.

The second partition panel 54 is separated from the first glue panel 52 by a cut line or severance line 73. The second partition panel 54 may be severably coupled to the first glue panel 52 by one or more connecting portions or nicks N which interrupt the cut line or severance line 73.

The first partition panel 50, third partition panel 58 and first glue panel 52 are defined in part by a cut line or severance line 75*b*. The first partition panel 50, third partition panel 58 and first glue panel 52 are separated from the first medial panel 22 by the cut line or severance line 75*b*. The first partition panel 50, third partition panel 58 and first glue panel 52 may be severably coupled to the first medial panel 22 by one or more connecting portions or nicks N which interrupt the cut line or severance line 75*b*.

The second partition panel 54 is separated from the first medial panel 22 by a cut line or severance line 75*c*. The second partition panel 54 may be severably coupled to the first medial panel 22 by one or more connecting portions or nicks N which interrupt the cut line or severance line 75*c*.

The third partition panel 58 is separated from the first medial panel 22 by a further cut line or severance line 75*a*. The third partition panel 58 may be severably coupled to the first medial panel 22 by one or more connecting portions or nicks N which interrupt the cut line or severance line 75*a*.

The first partition panel 50 is coupled, at a second or distal end, to the first glue panel 52 by a twistable strip 60, formed in part from a distal end portion of the first partition panel 50 and in part from a second end portion of the first glue panel 52. The twistable strip 60 extends between, and joins with, the first partition panel 50 and the first glue panel 52.

The first partition panel 50 has a length defined by a first distance, denoted by dimension arrow d1 in FIG. 1A, the first distance d1 is defined by a linear dimension extending between a proximal end fold line 51 of the first partition panel 50 and a distal end edge 63 of the first partition panel 50. The first distance d1 is generally equal to or less than a second distance between the first medial panel 22 and the first side wall panel 14 in a setup carrier 90.

The distal end portion of the first partition panel 50 is disposed in vertical alignment with the second end portion of the first glue panel 52.

The twistable strip 60 may form a single joint which connects between the distal end of the first partition panel 50 and the first glue panel 52.

The first glue panel 52 may comprise a glue-free region 65 along an end edge 64 thereof. The end edge 64 of the first glue panel 52 is continuous with the distal end edge 63 of the first partition panel 50. The glue-free region 65 extends along the distal end edge 63 into the first partition panel 50.

The glue-free region 65 extends continuously into the first partition panel 50.

The twistable strip 60 is defined at least in part by a tear stopper or element 62 disposed in at least one of the first partition panel 50 and the first glue panel 52.

The element 62 may take the form of a cutaway, extending in at least one of the first partition panel 50 and the first glue panel 52. The element 62 may be a cutline. The element 62 may be a nonlinear cutline or may be comprised of two or more divergently arranged linear cut lines. The element 62 may be arcuate or curvilinear. In other embodiments the element 62 may be an aperture, slot, slit, oval slot or frangible line. In the embodiment illustrated in FIG. 1A the element 62 is a curved element and extends into both the first partition panel 50 and the first glue panel 52. The curved element 62 comprises at least one terminal end which is spaced apart from an adjacent end edge of the twistable strip 60 provided by the end edge 64 of the first glue panel 52 or by the distal end edge 63 of the first partition panel 50 or by both the end edge 64 of the first glue panel 52 and the distal end edge 63 of the first partition panel 50.

The distal end edge 63 of the first partition panel 50 and the end edge 64 of the first glue panel 52 are arranged to be continuous and define an end edge of the first partition structure P1.

The at least one terminal end and the adjacent end edge 63, 64 of the twistable strip 60 define a second distance d3. The second distance d3 is defined by a linear dimension extending between the at least one terminal end and the end edge 63, 64 of the twistable strip 60.

The second distance d3 may be equal to or greater than the distance between the end edge 63, 64 of the twistable strip 60 and another part of the curved element 62.

The curved element 62 may be arranged such that at least one terminal end is directed away from the end edge 64 of the first glue panel 52 or from the distal end edge 63 of the first partition panel 50 or from both the end edge 64 of the first glue panel 52 and the distal end edge 63 of the first partition panel 50.

The cut line 71 separating the first partition panel 50 from the first glue panel 52 extends between the proximal end fold line 51 and the curved element 62. The curved element 62 may be formed from a C-shaped cut as illustrated in FIG. 1. In other embodiments the curved element 62 may be formed from a J-shaped cut, an oval slot or an aperture.

The glue-free region 65 includes at least an area defined between the end edge 63, 64 of the twistable strip 60 and a notional line X-X. The notional line X-X passes through the cut line 71 separating the first partition panel 50 from the first glue panel 52.

The notional line X-X may be spaced apart from the vertex or intersection between the cut line 71 and the curved element 62. The notional line X-X may be inset from said vertex or intersection.

The notional line X-X may be oriented perpendicular to the cut line 71.

The notional line X-X extends alongside the end edge 63, 64 of the first partition structure P1.

The notional line X-X may be oriented in parallel with the end edge 63, 64 of the twistable strip 60.

The notional line X-X may be oriented in parallel with the fold line 21 between the first medial panel and the first inner end panel 12.

The notional line X-X may pass through the at least one terminal end of the curved element 62. In the embodiment illustrated in FIG. 1A the notional line X-X passes through both terminal ends of the curved element 62. The notional line X-X extends along the end edge 63, 64 of the twistable strip 60.

The twistable strip 60 has a maximum width d3. In the illustrated embodiment, the maximum width d3 is defined between the at least one terminal end and the end edge 63, 64 of the twistable strip 60.

The twistable strip 60 is disposed at an elevation vertically offset from the distal end fold line 51.

In the illustrated embodiment the elevation of the twistable strip 60 is below the lower end of the distal end fold line 51. In other embodiments, the elevation of the twistable strip 60 may be above the upper end of the distal end fold line 51.

The first partition panel 50 comprises a proximal portion 72 connected to, or integral with, the first medial panel 22, an intermediate portion 74 joined to, or integral with, the proximal portion 72 and a distal portion 76 joined to, or integral with, the intermediate portion 74 and wherein the proximal and distal portions 72, 76 are disposed at their respective elevations vertically offset from each other.

The blank 10 comprises a second partition structure P2. The second partition structure P2 defines a plurality of cells disposed between the second side panel 18 and the second medial panel 24. The second side panel 18 and the second medial panel 24 along with portions of the first and second end panels 12, 16 define a second tubular structure or compartment on a second side of the medial structure.

The second compartment provides an interior chamber for accommodating at least a lower portion of one or more articles B.

The second partition structure P2 comprises a fourth partition panel 40 struck from the second medial panel 24 and hingedly connected, at a first or proximal end, thereto by a hinged connection in the form of a fold line 41.

The second partition structure P2 comprises a fifth partition panel 44 (also referred to herein as a second secondary partition panel) struck from the second medial panel 24 and hingedly connected, at first or a proximal end, thereto by a hinged connection in the form of a fold line 45.

The second partition structure P2 comprises a sixth partition panel 36/46 struck from the second medial panel 24 and hingedly connected thereto by a hinged connection in the form of fold lines 37, 47. The sixth partition panel 36/46 comprises an upper partition panel 36 (also referred to herein as a first secondary partition panel) and a lower partition panel 46 (also referred to herein as a third secondary partition panel). The upper partition panel 36 is hingedly connected, at first or a proximal end, to the second medial panel 24 by fold line 37 and the lower partition panel 46 is hingedly connected, at first or a proximal end, to the second medial panel 24 by fold line 47.

The fourth, fifth and sixth partition panels 40, 44, 36/46, also referred to collectively as secondary partition panels herein, are dimensioned to extend between the second medial panel 24 and the second side panel 18 in a set up condition.

The secondary partition panels 40, 44, 36/46 may be arranged to be disposed substantially parallel to one another. The upper partition panel 36 may be the end-most one of secondary partition panels 40, 44, 36/46. That is to say of the secondary partition panels 40, 44, 36/46 the upper partition panel 36 may be disposed closest to a free end edge E3 of the blank 10.

The second partition structure P2 comprises a second glue panel 42/48 to which the fourth and fifth partition panels 40, 44 are each coupled. The second glue panel 42/48 extends along the longitudinal axis x of the blank 10.

The upper and lower partition panels 36, 46 are disposed on opposing sides of the glue panel 42/48. The upper partition panel 36 is disposed on one side of the glue panel 42/48. The lower partition panel 46 is disposed on another side of the glue panel 42/48.

The glue panel 42/48 is interposed between the upper partition panel 36 and the first medial panel 22.

The lower partition panel 36 is interposed between the glue panel 42/48 and the first medial panel 2.

The fourth partition panel 40 (also referred to herein as a fourth secondary partition panel) is hingedly connected, at a second or distal end, to a first end of the glue panel 2 by a hinged connection in the form of fold line 43. Fold line 43 defines an outer end of the fourth partition panel 40, fold line 41 defines an inner end of the fourth partition panel 40.

The fourth partition panel 40 is hingedly connecting between the second glue panel 42/48 and the second medial panel 24, the fourth partition panel 40 interconnects the second glue panel 42/48 and the second medial panel 24.

The fourth partition panel 40 is arranged such that the fifth partition panel 44 is disposed between the upper partition panel 36 and the fourth partition panel 40. The fifth partition panel 44 is disposed on one side of the glue panel 42/48 (optionally, the same side as the upper partition panel 36) such that a portion of the second medial panel 24 is disposed between the glue panel 42/48 and the first medial panel 22; said portion of the second medial panel 24 is hingedly connected to the second primary partition panel along the fold line 23.

The fifth partition panel 44 is hingedly connected, at a second or distal end, to an intermediate portion of the second glue panel 42/48 by a hinged connection in the form of fold line 49. Fold line 49 defines an outer end of the fifth partition panel 44, fold line 45 defines an inner end of the fifth partition panel 44.

Fold line 43 is collinear with fold line 45 in the blank 10.

Fold line 45 is spaced apart from and parallel to fold line 37. Fold line 45 and fold line 37 are generally perpendicular to the longitudinal axis x of the blank 10.

The second glue panel 42/48 comprises a first portion 42 to which the fourth partition panel 40 is hingedly connected and a second portion 48 to which the fifth partition panel 44 is hingedly connected.

The upper partition panel 36 is separated from the lower partition panel 46 by the second glue panel 42/48.

The upper partition panel 36 is separated from the lower partition panel 46 by the second portion 48 of the second glue panel 42/48.

The upper partition panel 36 is coupled to the lower partition panel 46 by a glue flap 30. Glue flap 30 is hingedly connected to a second or distal end of the upper partition panel 36 by a hinged connection in the form of fold line 33*b*. Glue flap 30 is hingedly connected to a second or distal end of the lower partition panel 46 by a hinged connection in the form of fold line 33*a*.

The glue flap 30 may be unitary or integral with the second glue panel 42/48. In this way the glue flap 30 is joined to the second glue panel 42/48 in an uninterrupted fashion.

A cutline or severance line defines a lower edge of the fourth partition panel 40 and the second glue panel 42/48; the cutline separates the fourth partition panel 40 and a first portion of the second glue panel 42/48 from the second medial panel 24, the cutline separates a second portion 48 of the second glue panel 42/48 from the lower partition panel 46.

A further cutline or severance line defines an upper edge of the fourth partition panel 40 and the first portion of the second glue panel 42/48; the further cutline separates the fourth partition panel 40 from the second medial panel 24, the further cutline separates the first portion of the second glue panel 42/48 from the fifth partition panel 44.

Another cutline or severance line defines an upper edge of the fifth partition panel 44 and the second portion 48 of the second glue panel 42/48;

The upper partition panel 36 is separated, in part, from the second medial panel 24 by a first cut line or severance line 23*c*.

The upper partition panel 36 is separated, in part, from the second medial panel 24 by a first cutaway R1 in the form of a notch, slot or recess. The first cutaway R1 is struck from an end portion of the blank 10 so as to be defined in the end edge E3 of the blank 10.

The upper partition panel 36 is separated from the second glue panel 42/48 by a cut line 83.

The first cutaway R1 is arranged to be contiguous with the first cut line 23*c*.

The first cutaway R1 defines, at least in part, an upper edge E1 of the upper partition panel 36 or first secondary partition panel.

The lower partition panel 46 is separated, in part, from the first medial panel 22 by a second cut line or severance line 23*b*. At least a portion of the second cut line 23*b* may arranged collinearly with the fold line 23 hinging the first and second medial panels 22, 24 to each other.

The lower partition panel 46 is separated, in part, from the first medial panel 22 by a second cutaway R2 in the form of a notch, slot or recess. The second cutaway R2 is struck from an end portion of the blank 10 so as to be defined in the end edge E3 of the blank 10. The second cutaway R2 extends from the end edge E3 of the blank 10.

The lower partition panel 46 is separated from the second glue panel 42/48 by a cut line 81.

The second cutaway R2 may be offset from the portion of the second cut line 23*b* which is collinear with the fold line 23. The second cutaway R2 is arranged to be contiguous with the second cut line 23*b*.

The second cutaway R2 defines, at least in part, a lower edge E4 of the lower partition panel 46 or third secondary partition panel.

The upper partition panel 36 comprises a first or upper edge and a second or lower edge, the lower edge is adjoined or adjacent to the second glue panel 42/48. The lower edge extends entirely along the second glue panel 42/48, the second glue panel 42/48 is separated from the lower edge by a cut line 83.

The lower partition panel 46 comprises a first or upper edge and a second or lower edge, the lower edge opposes the upper edge. The upper edge of the lower partition panel 46 extends entirely along the second glue panel 42/48, the second glue panel 42/48 is separated from the upper edge by a cut line 81.

The lower edge of the lower partition panel 46 is defined at least in part by the second cutaway R2. The second cutaway R2 extends from the free end edge E3 of the blank 10.

The lower edge of the lower partition panel 46 is disposed adjacent to the first medial panel 22; in this way no other part of the blank 10 is disposed between the lower partition panel and the first medial panel 22.

The lower partition panel 46 may be beneficial over a second partition structure P2 in which lower partition panel 46 is omitted. One advantage of providing the lower partition panel 46 may be increased stability during assembly of the blank 10 into a flat collapsed carrier by a packaging machine. Providing the lower partition panel 46 may prevent or mitigate against skewing, or misalignment of the second partition structure P2. The lower partition panel 46 may facilitate an increase in the accuracy or precision or both of the assembly process.

The first and second cutaways R1, R2 may be advantageous over interrupted cut lines or frangible lines since they do not require severing or breaking to enable the blank 10 to be manipulated or folded.

When the first and second cutaways R1, R2 are employed in the end region of the blank 10, the assembly process may be more readily automated. The need for a packaging machine to provide a tool for breaking a frangible line which can operate in the end region of the blank 10 is eliminated. This may be advantageous in enabling the packaging machine to be more compact, a nick breaking station may be disposed closer to belt feeder that conveys blanks 10 through the packaging machine. The belt feeder may comprise at least one pair of driven belts, the blank 10 being fed between the pair of driven belts, so that a first belt engages an upper surface of the blank 10 and a second belt engages a lower surface of the blank 10. Additionally or alternatively, the separation between a belt feeder upstream of the nick breaking station and a belt feeder downstream of the nick breaking station may be reduced or eliminated. In this way the likelihood of blanks 10 being misfed or jammed is decreased.

In this way the consistency of the carriers 90 produced by the packaging machine may be improved.

The first and second cutaways R1, R2 may take the form of "V" shaped notches or recesses and may extend transversely of the fold lines 37, 47. In this way, the first and second cutaways R1, R2 each comprise opposed free edges which are obliquely oriented with respect to a longitudinal direction x (or to the longitudinal axis of the blank) as well as to a transverse direction y of the blank 10. This may be beneficial in preventing or mitigating against jamming of one blank on another blank when fed from a hopper or preventing or mitigating against catching on parts of the packaging machine such as but not limited to the belt feeder.

The opposed free edges E1, E2 of the first cutaway R1 each is disposed obliquely or angled with respect to the longitudinal axis of the blank which is parallel to the fold line 23 and generally perpendicular to the fold lines 37, 47. The opposed free edges E1, E2 may define an acute angle therebetween. The acute angle may be less than 30° and optionally may be or less.

The opposed free edges E4, E5 of the second cutaway R2 each is also disposed obliquely or angled with respect to the longitudinal axis of the blank. The opposed free edges E4, E5 may define an acute angle therebetween. The acute angle may be less than 30° and optionally may be 20° or less.

The blank 10 is foldable to form a package 90 as illustrated in FIG. 2.

Turning to the construction of the carton 90 as illustrated in FIG. 2, the carton 90 can be formed by a series of sequential folding operations in a straight-line machine so that the carton 90 is not required to be rotated or inverted to complete its construction. The folding process is not limited to that described below and may be altered according to particular manufacturing requirements.

In some embodiments the blank 10 is oriented such that the long axis (longitudinal direction x) of the blank 10 is transverse to the flow direction of the blank in the packaging machine. The first medial panel 22 may be disposed upstream of the second medial panel 24, in this way the second medial panel 24 leads the first medial panel 22. The second medial panel 24 provides at least a part of a leading edge of the blank 10 and the first medial panel 22 provides at least a part of a trailing edge of the blank 10.

Glue or other adhesive treatment is applied to one or both of the first and second medial panels 22, 24.

Figure 4:
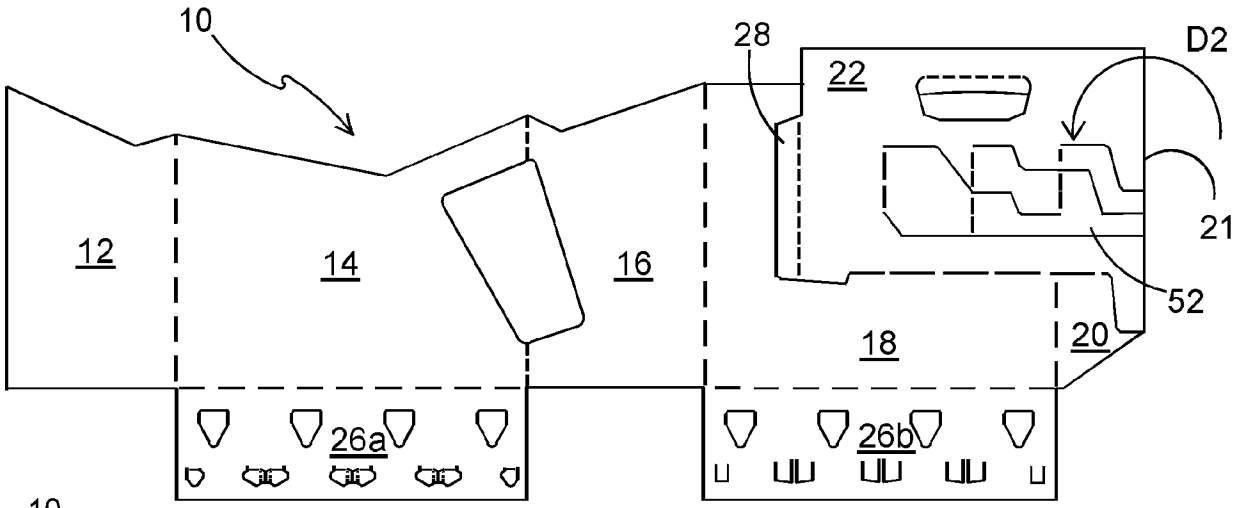

The second medial panel 24 is folded, with respect to the first medial panel 22 about fold line 23, as indicated by direction arrow D1 shown in FIG. 4. The second medial panel 24 is secured to the first medial panel 22 in face contacting relationship therewith.

Glue or other adhesive treatment is applied to the second glue panel 42/48. Alternatively, glue or other adhesive treatment may be applied to a corresponding region of the second side panel 18.

Figure 5:
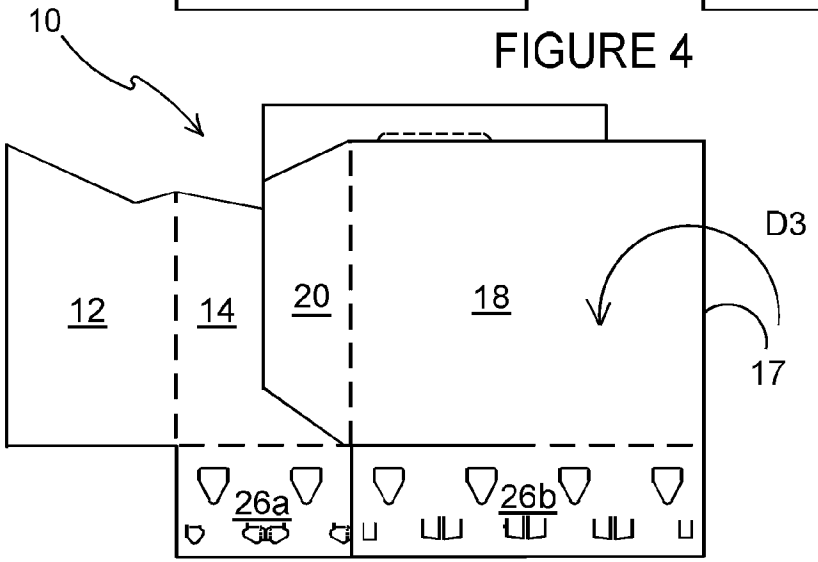

The first medial panel 24 (and consequently the second medial panel 24) is folded, with respect to the first inner end panel 20 about fold line 21, as indicated by direction arrow D2 shown in FIG. 5. The second medial panel 24 is brought into face to face relationship with the second side panel 18 and the first inner end panel 20. The second glue panel 42/48 is secured to the second side panel 18 in face contacting relationship therewith.

Glue or other adhesive treatment is applied to the first glue panel 52. Alternatively, glue or other adhesive treatment may be applied to a corresponding region of the first side panel 14.

Glue or other adhesive treatment is applied to the medial partition glue flap 28. Alternatively, glue or other adhesive treatment may be applied to a corresponding region of the second end panel 16.

Figure 6:
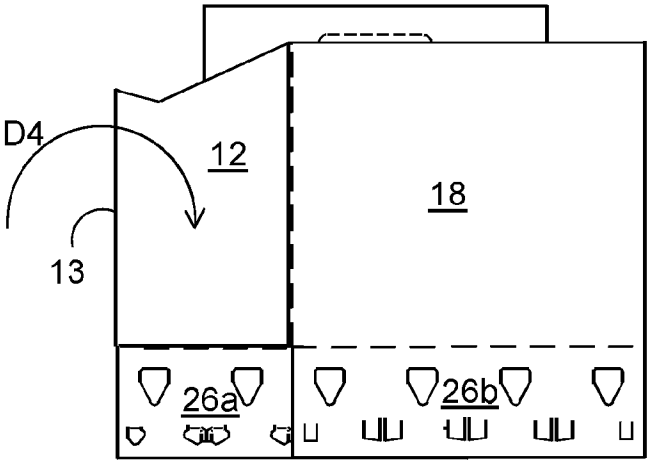

The second side panel 18, together with the first and second medial panel 22, 24, is folded about the fold line 17 to bring the first medial panel 22 into face to face relationship with the second end panel 16 and the first side panel 14, as indicated by direction arrow D3 in FIG. 6.

The medial partition glue flap 28 is secured to the second end panel 16.

The first glue panel 52 is secured to the first side panel 14.

Glue or other adhesive treatment is applied to the first inner end panel 20. Alternatively, glue or other adhesive treatment may be applied to a corresponding region of the first outer end panel 12.

The first outer end panel 12 is folded about the fold line 13 as indicated by direction arrow D4 in FIG. 7 so as to be disposed in face to face relationship with the first inner end panel 20.

The first outer end panel 12 is secured to the first inner end panel 20. In this way a flat collapsed tubular structure is formed.

A flat collapsed carrier is thereby formed, as shown in FIG. 7, the flat collapsed carrier can be readily shipped or distributed in the flat condition to a plant for erecting and loading with primary product containers.

The flat collapsed carrier can be opened into a basket-style article carrier by separating the first and second side panels 14, 18 to form a tubular structure defined by the main panels 12, 14, 16, 18, 20. The main panels 12, 14, 16, 18, 20 define an interior chamber. The partition structures P1, P2 are automatically erected when the flat collapsed carrier is opened out or erected into the tubular form.

Once the carrier 90 is erected, the first and second medial panels 22, 24 form a partition, that is disposed medially within the interior of the carrier 90 formed by the main panels 12, 14, 16, 18, 20. The partition divides the interior of the carrier 90 into two separate compartments on opposing sides of the first and second medial panels 22, 24.

The first partition structure P1 is automatically erected to form a first plurality of cells in a first compartment disposed on a first side of the first and second medial panels 22, 24.

The second partition structure P2 is automatically erected to form a second plurality of cells in a second compartment disposed on a second side of the first and second medial panels 22, 24.

The carrier 90 may be loaded with a group of articles B; in the embodiment illustrated in FIG. 2 eight articles B are arranged in a 4×2 array.

The group of articles B may be loaded through a lower end of the tubular structure formed by the main panels 12, 14, 16, 18, 20 prior to folding the first and second base panel 26*a*, 26*b*. Alternatively, the group of articles B may be loaded through an upper end of the tubular structure subsequent to assembly of the composite base panel 26*a*, 26*b*.

The second base panel 26*b* is folded with respect to the second side panel 18 about fold line 25*b*. The first base panel 26*a* is folded with respect to the first side panel 14 about fold line 25*a*. The first base panel 26*a* is brought into face contacting relationship with the second base panel 26*b*. The first base panel 26*a* is disposed in at least partial overlapping relationship with the second base panel 26*b*.

Each of the first parts M of the complementary locking mechanism is aligned with a respective one of the second parts F of the complementary locking mechanism. The first parts M of the complementary locking mechanism are folded inwardly of the interior of the carrier such that they are received by the second parts F of the complementary locking mechanism, when the second parts F of the complementary locking mechanism comprises female tabs these are also folded inwardly and may bear against the first parts M of the complementary locking mechanism.

In the embodiment illustrated in FIG. 1 the third partition panel 58 and of a fourth partition panel 40 have an irregular hexagon shape.

The cutline 75*a* comprises a first portion oriented substantially parallel to fold line 23 and a second portion oriented obliquely thereto. The first portion of the cutline 75*a* and the second portion of the cutline 75*a* and define an angle therebetween, the angle defined may be between 90° and 130°, optionally between 120° and 130°. The cutline 75*b* comprises a first portion oriented substantially parallel to fold line 23 and a second portion oriented obliquely thereto. The first portion of the cutline 75*b* and the second portion of the cutline 75*b* and define an angle therebetween, the angle defined may be between 90° and 130°, optionally between 120° and 130°.

The second portion of the cutline 75*a* and the second portion of the cutline 75*b* are longitudinally offset from each other such that none of the second portion of the cutline 75*a* is disposed vertically above the second portion of the cutline 75*b*. This may be advantageous in preventing, inhibiting or reducing the likelihood of either or both of the third and fourth partition panels 58, 40 to bend or deform.

The second portion of the cutline 75*a* and the second portion of the cutline 75*b* may be vertically offset from each other such that none of the second portion of the cutline 75*a* is disposed at the same elevation as the second portion of the cutline 75*b*.

Intermediate portions of the cut lines defining upper and lower edges of the first partition panel 50 are similarly arranged so as to be longitudinally offset from each other such that none of the intermediate portion of the cutline defining the upper edge of the first partition panel 50 is disposed vertically above the intermediate portion of the cutline defining the lower edge of the first partition panel 50. This may be advantageous in preventing, inhibiting or reducing the likelihood of the first partition panel 50 to bend or deform.

An advantage of the present disclosure is that the first partition structure comprises a reduced footprint for example when compared to the second partition structure P2 illustrated in FIG. 1, that is to say it occupies less area of the blank. The first partition structure may also comprise a reduced linear dimension, in the longitudinal direction. In this way the first partition structure may be struck from within the first medial panel.

The first partition structure may extend up to an edge of the first medial panel without extending beyond the edge of the first medial panel. In some embodiments this has the benefit that a panel adjacent to the first medial panel and hinged thereto is not interrupted or broken by the first partition structure, this may have structural benefits or aesthetic benefits or both.

Additionally or alternatively, this may be beneficial when constructing the blank into a carrier, in particular into the flat collapsed carrier, such as that illustrated in FIG. 7. Construction of the blank into the carrier may be more readily automated. The reduction in size of the first partition structure may reduce the likelihood of the blank colliding with, catching upon, or otherwise unintentionally engaging with a part of a packaging machine, thus avoiding or mitigating against the blank becoming entangled, trapped, misfed or misaligned during the assembly process.

It can be appreciated that various changes may be made within the scope of the present invention. For example, the size and shape of the panels and apertures may be adjusted to accommodate articles of differing size or shape. The present disclosure is not limited to cartons of the basket carrier style, the invention may be employed with other carton styles such as, but not limited to, open top crates, lidded or closed top crates and fully enclosed cartons.

In alternative embodiments, the blank 10 may comprise a single primary partition panel. The second medial panel 24 may be omitted. The first partition structure P1 may be omitted from the first medial panel 24 and replaced by the second partition structure P2. Alternatively, the first medial panel 24 may comprise two or more partition structures at least one of which takes the form of the second partition structure P2.

It will be recognised that as used herein, directional references such as "top", "bottom", "base", "front", "back", "end", "side", "inner", "outer", "upper" and "lower" do not necessarily limit the respective panels to such orientation but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line or a severance line or both. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A blank for forming a carton, the blank comprising a partition-forming section, wherein the partition-forming section comprises:

a first primary partition panel and a second primary partition panel hingedly connected to the first primary partition panel along a first fold line that is parallel to a longitudinal axis of the blank;

a first secondary partition panel and a second secondary partition panel, each of the first secondary partition panel and the second secondary partition panel being formed from the first primary partition panel, wherein the first secondary partition panel is hingedly connected to the first primary partition panel by a second fold line and the second secondary partition panel is hingedly connected to the first primary partition panel by a third fold line, the second fold line and the third fold line being spaced apart from each other and disposed generally perpendicular to the longitudinal axis; and a glue panel hingedly connected to each of the first secondary partition panel and the second secondary partition panel via a common glue flap, such that the glue panel is interposed between the first secondary partition panel and the second secondary partition panel, with the first secondary partition panel disposed on one side of the glue panel and the second secondary partition panel disposed on an opposite side of the glue panel that opposes the one side, wherein the second secondary partition panel comprises a first edge extending adjacently along the glue panel and a second edge disposed opposite to the first edge and immediately adjacent to the second primary partition panel.

2. The blank of claim 1 wherein the second edge of the second secondary partition panel is separated from the second primary partition panel at least partially by a second cutaway extending from a free end edge of the blank.

3. The blank of claim 2, wherein an edge of the second cutaway is disposed obliquely with respect to the longitudinal axis of the blank.

4. The blank of claim 1 wherein the first secondary partition panel comprises a first edge and a second edge disposed opposite to the first edge, wherein the first edge is adjoined or adjacent to the glue panel.

5. The blank of claim 4 wherein the second edge of the first secondary partition panel is separated from the first primary partition panel at least partially by a first cutaway extending from a free end edge of the blank.

6. The blank of claim 5, wherein an edge of the first cutaway is disposed obliquely with respect to the longitudinal axis of the blank.

7. The blank of claim 1 wherein the partition-forming section further comprises a third secondary partition panel hingedly connecting between the glue panel and the first primary partition panel.

8. The blank of claim 7 wherein the third secondary partition panel is hingedly connected to the first primary partition panel by a fourth fold line that is disposed generally perpendicular to the longitudinal axis, the third secondary partition panel being hingedly connected to an end of the glue panel such that a portion of the first primary partition panel is disposed between the third secondary partition panel and the second primary partition panel and said portion of the first primary partition panel is hingedly connected to the second primary partition panel along the first fold line.

9. The blank of claim 8 wherein the portion of the first primary partition panel is configured to be glued to the second primary partition panel when the blank is erected into a carton.

10. The blank of claim 1 further comprising a medial partition glue flap hingedly connected to one end of at least one of: (i) the first primary partition panel, and (ii) the second primary partition panel.

11. The blank of claim 1 wherein at least one of the first primary partition panel and the second primary partition panel comprises a handle structure.

12. The blank of claim 11 wherein the handle structure comprises a handle opening defined in part by a handle aperture struck from an upper portion of the at least one of the first primary partition panel and the secondary primary partition panel.

13. The blank of claim 1 wherein the second primary partition panel comprises a partition structure defining at least one article-receiving cell when the blank is erected into a carton.

14. The blank of claim 13 wherein the partition structure comprises a partition panel struck from the second primary partition panel and hingedly connected thereto by a fold line.

15. The blank of claim 13 wherein the at least one article-receiving cell comprises a plurality of article-receiving cells, and wherein the partition structure comprises a plurality of partition panels struck from the second primary partition panel and hingedly connected thereto by respective fold lines.

16. The blank of claim 7, wherein the partition-forming section further comprises a fourth secondary partition panel hingedly connected between the glue panel and the first primary partition panel.

17. The blank of claim 16 wherein a combination of the first secondary partition panel, the second secondary partition panel, the third secondary partition panel, and the fourth secondary partition panel forms a partition structure defining at least one article-receiving cell when the blank is erected into a carton.

18. A carton comprising a partition structure, the partition structure comprising:

a first primary partition panel and a second primary partition panel hingedly connected to the first primary partition panel along a first fold line, the first primary partition panel being in substantial face-contacting relationship with the second primary partition panel;

a first secondary partition panel and a second secondary partition panel, each of the first secondary partition panel and the second secondary partition panel being formed from the first primary partition panel and defining at least one article-receiving cell, each cell configured to hold an article therein, wherein the first secondary partition panel is hingedly connected to the first primary partition panel by a second fold line and the second secondary partition panel is hingedly connected to the first primary partition panel by a third fold line, the second fold line and the third fold line being spaced apart from each other and disposed generally perpendicular to the first fold line; and a glue panel hingedly connected to each of the first secondary partition panel and the second secondary partition panel via a common glue flap such that the glue panel is interposed between the first secondary partition panel and the second secondary partition panel, wherein an edge of the first secondary partition panel is defined at least in part by a first cutaway and an edge of the second secondary partition panel is defined at least in part by a second cutaway.

19. The carton of claim 18, wherein the second primary partition panel comprises a plurality of partition panels formed from the second primary partition panel and defining at least one article-receiving cell, each cell configured to hold an article therein.

20. The carton of claim 18, wherein the partition structure further comprises a third secondary partition panel formed from the first primary partition panel and hingedly connecting between the glue panel and the first primary partition panel, wherein a portion of the first primary partition panel is disposed between the third secondary partition panel and the first fold line and the portion of the first primary partition panel is glued to the second primary partition panel.

* * * * *